US006311414B1

(12) United States Patent
Kita

(10) Patent No.: US 6,311,414 B1
(45) Date of Patent: Nov. 6, 2001

(54) ATHLETIC SHOE MIDSOLE DESIGN AND CONSTRUCTION

(75) Inventor: Kenjiro Kita, Osaka (JP)

(73) Assignee: Mizuno Corporation, Osaka (JP)

( * ) Notice: Subject to any disclaimer, the term of this patent is extended or adjusted under 35 U.S.C. 154(b) by 0 days.

(21) Appl. No.: 09/339,269

(22) Filed: Jun. 23, 1999

(30) Foreign Application Priority Data

Jun. 25, 1998 (JP) ..... 10-196567

(51) Int. Cl.[7] ..... A43B 13/12; A43B 13/14; A43B 13/20; A43B 21/26; A43B 21/32

(52) U.S. Cl. ..... 36/28; 36/29; 36/25 R; 36/35 R; 36/31; 36/37; 36/35 B

(58) Field of Search ..... 36/27, 28, 30 R, 36/35 R, 25 R, 31, 92, 87, 102, 30 A, 36 A, 37, 71, 44, 114, 88, 76 C, 103, 29, 32 R

(56) References Cited

U.S. PATENT DOCUMENTS

| | | | | |
|---|---|---|---|---|
| 1,050,807 | * | 1/1913 | Chamberlain | 36/29 |
| 2,364,134 | | 12/1944 | Dow et al. . | |
| 2,677,906 | * | 5/1954 | Reed | 36/44 |
| 4,356,642 | * | 11/1982 | Herman | 36/44 |
| 4,561,195 | | 12/1985 | Onoda et al. . | |
| 4,774,774 | * | 10/1988 | Allen, Jr. | 36/29 |
| 4,798,010 | * | 1/1989 | Sugiyama | 36/30 R |
| 4,805,319 | | 2/1989 | Tonkel . | |
| 4,864,737 | | 9/1989 | Marello . | |
| 4,999,931 | * | 3/1991 | Vermeulen | 36/29 |
| 5,185,943 | | 2/1993 | Tong et al. . | |
| 5,606,807 | * | 3/1997 | Prepodnik | 36/8.1 |
| 5,799,415 | * | 9/1998 | Kenji et al. | 36/44 |

FOREIGN PATENT DOCUMENTS

| | | | | |
|---|---|---|---|---|
| 19641866 | * | 12/1996 | (DE) | 36/29 |
| 2032760 | | 5/1980 | (GB) . | |
| 61-6804 | | 3/1986 | (JP) . | |
| 11-203 | | 11/1999 | (JP) . | |
| WO90/06699 | | 6/1990 | (WO) . | |

* cited by examiner

*Primary Examiner*—M. D. Patterson
*Assistant Examiner*—Anthony Stashick

(57) ABSTRACT

An athletic shoe midsole assembly includes a midsole formed of soft elastic material and a corrugated sheet disposed in the heel portion of the midsole. The corrugated sheet has a pocket structure at edge areas of the sheet, for example the medial side edge, formed by two layers spaced apart from each other with a respective void pocket formed therebetween. Since the compressive hardness of the midsole is higher on the medial side including the pocket structure, transverse deformation of the shoe on landing can be prevented and over-pronation can be restrained on this medial side and the loss of athletic power can be decreased. On the other hand, flexibility of the midsole is maintained on the lateral side without a pocket structure and thus cushioning properties can be secured on this lateral side.

16 Claims, 11 Drawing Sheets

ATHLETIC SHOE MIDSOLE DESIGN AND CONSTRUCTION

CROSS-REFERENCE TO RELATED APPLICATIONS

This application is related to: U.S. application Ser. No. 09/314,366, filed on May 19, 1999; U.S. application Ser. No. 09/318,578, filed on May 25, 1999; U.S. application Ser. No. 09/395,516, filed on Sep. 14, 1999; and U.S. application Ser. No. 09/437,918, filed on Nov. 10, 1999.

BACKGROUND OF THE INVENTION

The present invention relates to an athletic shoe midsole design and construction. More particularly, the invention relates to a midsole assembly comprising a midsole formed of soft elastic material and a corrugated sheet disposed in the midsole.

The sole of an athletic shoe used in various sports is generally comprised of a midsole and an outsole. The midsole is typically formed of soft elastic material in order to ensure adequate cushioning properties. The outsole is fitted under the midsole and directly contacts with the ground.

Running stability as well as adequate cushioning properties are required in athletic shoes. Consequently, there is a need to prevent shoes from being deformed excessively in the lateral or transverse direction when contacting with the ground.

As shown in Japanese Utility Model Examined Publication No. 61-6804, the assignee of the present U.S. application proposes a midsole assembly having a corrugated sheet therein, which can prevent such an excessive lateral deformation of shoes.

The midsole assembly shown in the above publication incorporates a corrugated sheet in the heel portion of a midsole, thereby producing resistant force that prevents the heel portion of a midsole from being deformed laterally or transversely when a shoe comes in contact with the ground. Thus, transverse deformation of the heel portion of a shoe is prevented.

However, it depends on the kind of athletics or athletes whether athletes land on the ground more frequently from the medial portions or from the lateral portions of the heels at the onset of landing. For example, since tennis or basketball players move more often in the transverse direction and the medial portions of their heels tend to first contact with the ground, the heels lean outwardly and so-called supination often occurs. On the other hand, since runners or joggers tend to land on the ground from the lateral portions of their heels and the load moves toward the toes, the heels lean inwardly and so-called pronation often occurs.

Such pronation and supination are normal movements when a shoe comes in contact with the ground. But over-pronation or over-supination may cause injuries to the ankle, knee and hip of an athlete.

In the conventional midsole design, there is provided a corrugated sheet having a constant wave configuration in both the transverse direction and the longitudinal direction of the heel portion. Therefore, the prior art midsole has a constant compressive hardness (hardness to deform against the compressive force) throughout the whole midsole and as a result, it cannot control effectively pronation and supination of the foot of an athlete although controlling them is required according to the kind of athletics.

Generally, by inserting a corrugated sheet, the heel portion of a midsole tends to be less deformed in the transverse direction. When the corrugated sheet is formed especially from high elastic material the heel portion of a midsole tends to be less deformed in the vertical direction as well. Thus, by using a corrugated sheet, a portion where adequate cushioning properties is required on landing may show less cushioning properties.

On the other hand, good cushioning properties are indispensable requirements of athletic shoes, but too high cushioning properties may absorb an athletic power such as the running or jumping power of an athlete.

The object of the present invention is to provide a midsole assembly for an athletic shoe that can restrain over-pronation and over-supination on landing by preventing a shoe from being deformed in the transverse direction according to the kind of athletics and that can not only ensure adequate cushioning properties on landing but also prevent an athletic power from being lessened.

SUMMARY OF THE INVENTION

The present invention provides a midsole assembly for an athletic shoe.

In one embodiment, a midsole assembly comprises a midsole formed of soft elastic material and a corrugated sheet disposed in at least a heel portion of the midsole. At least a portion of the outer circumference side of the corrugated sheet has a double structure. The double structure is comprised of two sheets or layers of corrugated sheets. These corrugated sheets or layers are spaced apart from each other at a predetermined space in the thickness direction to form respective pockets or voids therebetween.

In a second embodiment, the double structure is formed only on the medial side of the midsole. In a third embodiment, the double structure is formed only on the lateral side of the midsole. In a fourth embodiment, the double structure is formed on both the medial and lateral side of the midsole.

A fifth embodiment provides a midsole assembly according to any one of the first to fourth embodiments, wherein the double structure is formed on either or both the crest side and the trough side of the wave configuration of the corrugated sheet.

A sixth embodiment provides a midsole assembly according to any one of the first to fourth embodiments, wherein the double structure is formed on an inclined surface between the adjacent crest and trough of the wave configuration of the corrugated sheet.

In a seventh embodiment, the crest line or trough line of the wave configuration of the corrugated sheet extends substantially in the shoe width direction.

In an eighth embodiment, the crest line or trough line of the wave configuration of the corrugated sheet extends radially.

In a ninth embodiment, a midsole assembly comprises a midsole formed of soft elastic material and a corrugated sheet disposed in at least a heel portion of the midsole. At least a portion of the outer circumference side of the corrugated sheet has a multiple structure. The multiple structure is comprised of a plurality of sheets or layers of corrugated sheets. Each of the corrugated sheets or layers is spaced apart from each other at a predetermined space in the thickness direction to form respective voids or pockets therebetween.

In the first embodiment, a corrugated sheet is disposed in at least a heel portion of the midsole and at least a portion of the outer circumference side of the corrugated sheet has a double structure. The double structure is comprised of two sheets of corrugated sheets. These corrugated sheets are spaced apart at a predetermined space in the thickness direction.

Thus, at a portion where a double structure is provided, rigidity of the corrugated sheet is further increased and the compressive hardness of the midsole is made greater. Thereby, transverse deformation of a shoe can be prevented and unnecessary sinking of the heel of a foot into a midsole can be restrained, and as a result, loss of athletic power can be decreased. In contrast, at other portions where a double structure is not provided, compressive hardness is relatively lower as compared to the portion of a double structure and flexibility of a midsole is maintained to some extent, and thus, shock load on landing is relieved and the cushioning properties can be secured.

In the second embodiment, the double structure is formed only on the medial side of the midsole. Thus, the compressive hardness of a midsole is higher on the medial side and flexibility of a midsole is maintained on the lateral side. Thereby, in athletics where athletes land more frequently from the heel lateral portion, shock load on landing is effectively relieved and the cushioning properties can be ensured, and besides, transverse deformation of a heel portion after landing can be prevented.

Moreover, when the heel of a foot pronates after landing, the heel of a foot is restrained from unnecessarily sinking toward the medial side of a midsole by a heel medial side portion having a larger compressive hardness. Thereby, over-pronation can be prevented.

In the third embodiment, the double structure is formed only on the lateral side of the midsole. Thus, the compressive hardness of a midsole is higher on the lateral side and flexibility of a midsole is maintained on the medial side. Thereby, in athletics where athletes land more frequently from the heel medial portion, shock load on landing is effectively relieved and the cushioning properties can be ensured, and besides, transverse deformation of a heel portion after landing can be prevented.

Moreover, when the heel of a foot supinates after landing, the heel of a foot is restrained from unnecessarily sinking toward the lateral side of a midsole by a heel lateral side portion having a larger compressive hardness. Thereby, over-supination can be prevented.

In the fourth embodiment, the double structure is formed on both the medial and lateral sides of the midsole.

Thus, the compressive hardness of a midsole is higher on the medial and lateral sides and flexibility of a midsole is maintained on the central portion. Thereby, the cushioning properties on landing can be ensured on the heel central portion, and besides, transverse deformation of a heel portion after landing can be prevented and the running stability can be improved.

In the fifth embodiment, the double structure is formed on either the crest side or the trough side, or both the crest side and the trough side of the wave configuration of the corrugated sheet. When the double structure is formed on both the crest and trough sides of the wave configuration, the compressive hardness of a midsole can be made further greater on these crest and trough sides.

In addition, the double structure may be formed on the inclined surface between the adjacent crest and trough of the wave configuration of the corrugated sheet, as described in the sixth embodiment.

The crest line or the trough line of the wave configuration of the corrugated sheet may extend in the shoe width direction, as described in the seventh embodiment. Alternatively, the crest line or the trough line of the wave configuration may extend radially, as described in the eighth embodiment. In this case, center of radiation or radiant point may be placed inside or outside the heel portion of a midsole, or on the edges of the outer circumference. The radiant angle may be acute or obtuse.

In the ninth embodiment, at least a portion of the outer circumference side of the corrugated sheet has a multiple structure. The multiple structure is comprised of a plurality of sheets of corrugated sheets. These corrugated sheets are spaced apart at a predetermined space in the thickness direction.

In this case, at a portion where a multiple structure is provided, rigidity of the corrugated sheet can be further increased and the compressive hardness of the midsole is made further greater. Thereby, transverse deformation of a shoe can be prevented more effectively.

BRIEF DESCRIPTION OF THE DRAWINGS

For a more complete understanding of the invention, reference should be made to the embodiments illustrated in greater detail in the accompanying drawings and described below by way of examples of the invention. In the drawings, which are not to scale.

DETAILED DESCRIPTION OF THE PREFERRED EMBODIMENTS

Figure 1:
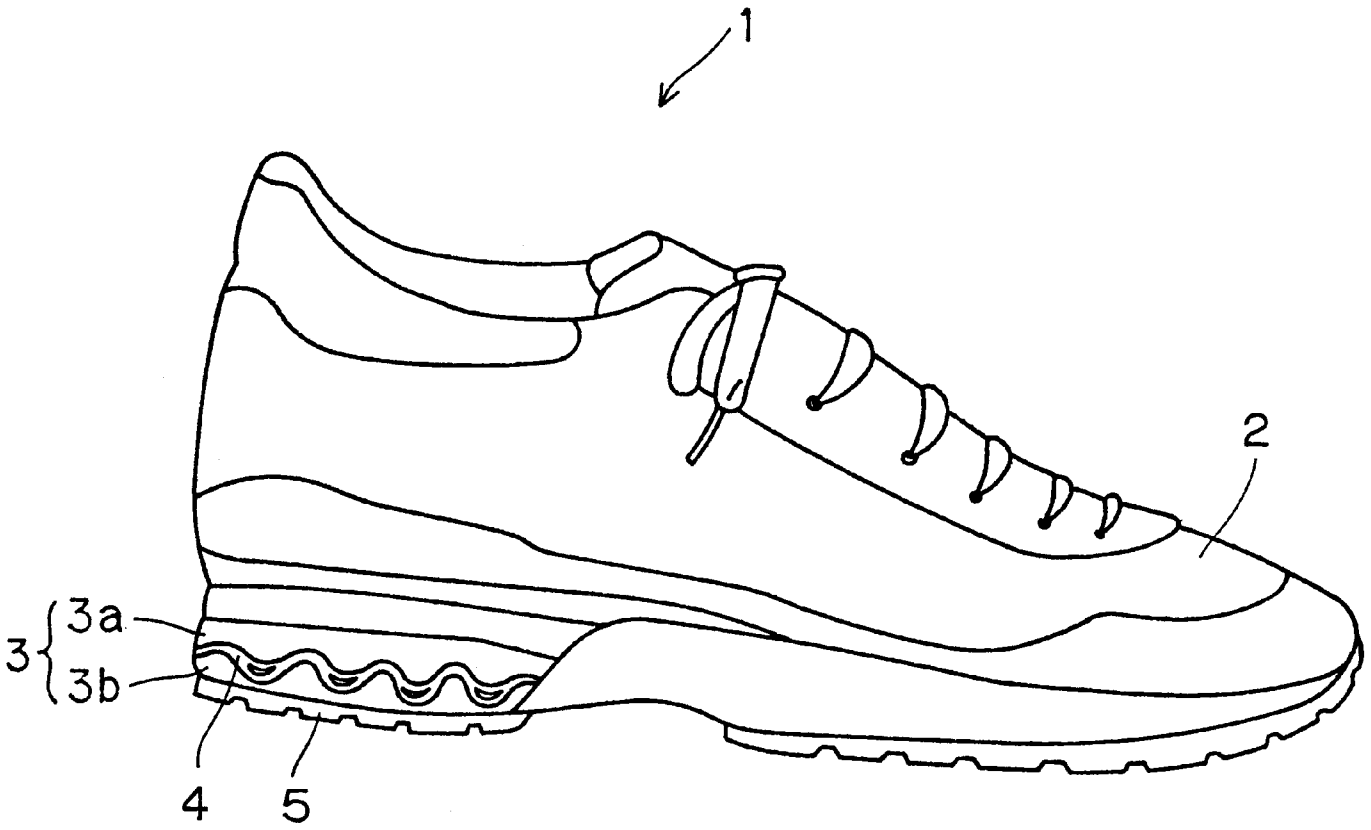
FIG. 1 is a side view of an athletic shoe incorporating the midsole construction of the present invention.

Turning now to the drawings, FIG. 1 illustrates an athletic shoe incorporating a midsole construction of the present invention. The sole of this athletic shoe 1 comprises a midsole 3, a corrugated sheet 4 and an outsole 5 directly contacting with the ground. The midsole 3 is fitted to the bottom of the uppers 2. The corrugated sheet 4 having a wavy configuration is disposed in the midsole 3. The outsole 5 is fitted to the bottom of the midsole 3.

The midsole 3 is provided in order to absorb a shock load imparted on the heel portion of the shoe 1 when a shoes wearer lands on the ground. The midsole 3 is comprised of an upper midsole 3*a* and a lower midsole 3*b* which are respectively disposed on the top and bottom surfaces of the corrugated sheet 4. That is, the corrugated sheet 4 is interposed between the upper midsole 3*a* and the lower midsole 3*b,* and the sheet 4 is integrated with the upper and lower midsoles 3*a,* 3*b.*

The midsole 3 is generally formed of soft elastic material having good cushioning properties. Specifically, thermoplastic synthetic resin foam such as ethylene-vinyl acetate copolymer (EVA), thermosetting resin foam such as polyurethane(PU), or rubber material foam such as butadiene or chloroprene rubber are used.

The corrugated sheet 4 is formed of thermoplastic resin such as thermoplastic polyurethane(TPU) of comparatively rich elasticity, polyamide elastomer(PAE), ABS resin and the like. Alternatively, the corrugated sheet 4 is formed of thermosetting resin such as epoxy resin, unsaturated polyester resin and the like.

Generally, in this midsole construction, the pressure imparted from the upper midsole 3*a* on landing is dispersed by the corrugated sheet 4 and the pressured area of the lower midsole 3*b* becomes enlarged. As a result, compressive hardness throughout the whole midsole construction is made higher.

Moreover, in this embodiment, there is provided a double structure, which has double corrugated sheets 4 or sheet layer portions spaced apart at a predetermined space, on the trough side of the wave configuration of a corrugated sheet 4.

Figure 2:
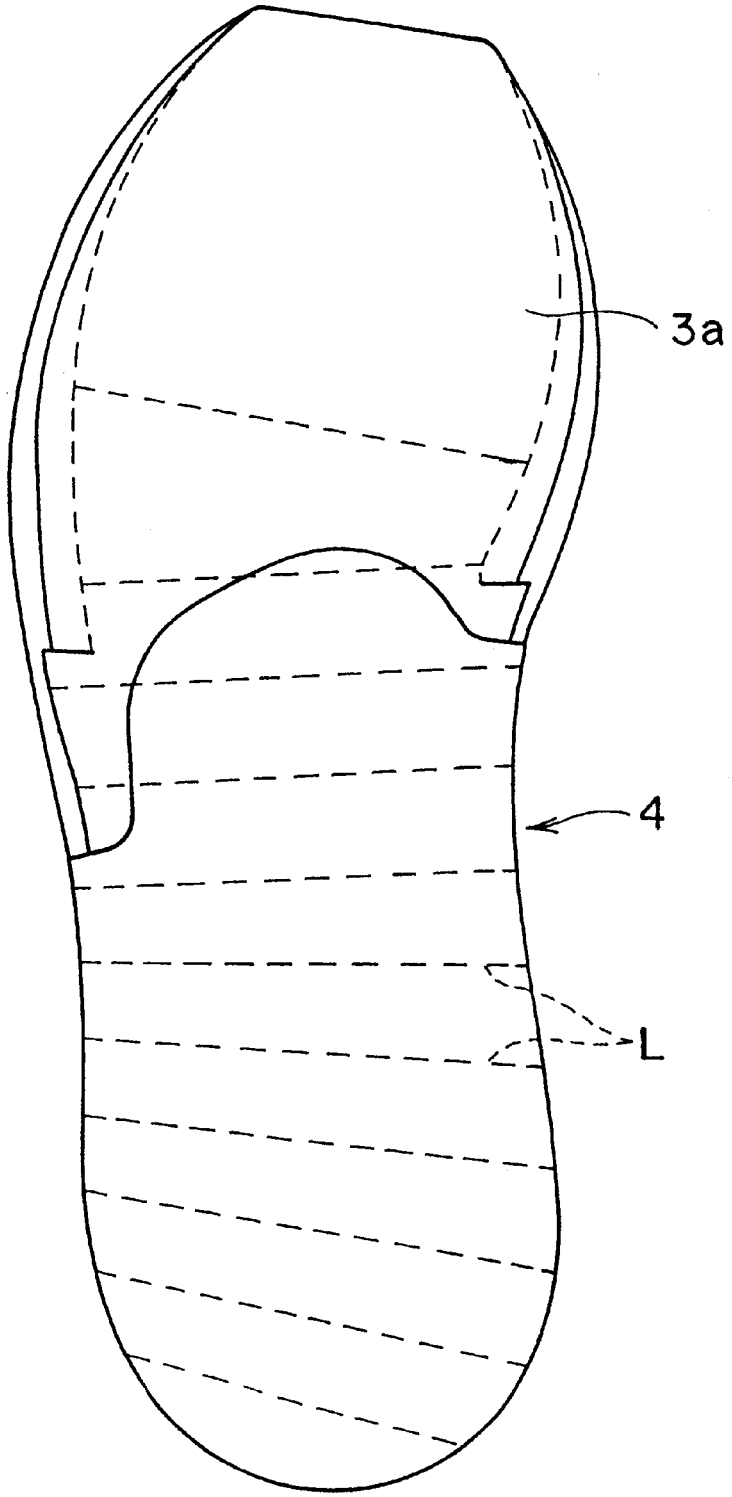
FIG. 2 is a top plan view of the left side midsole construction of the present invention.
Figure 3A:
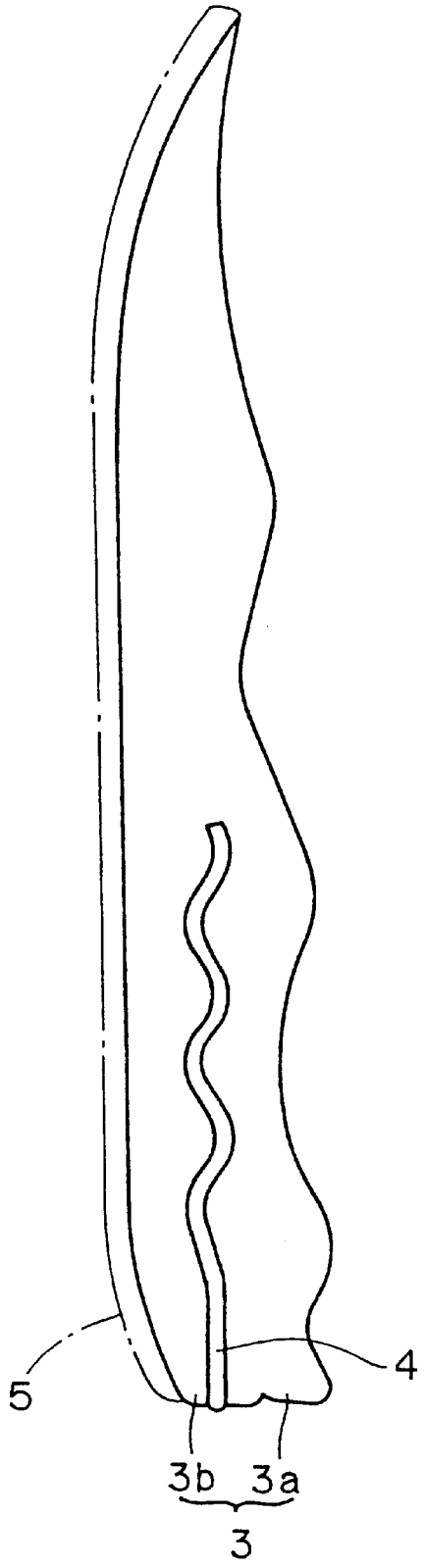
FIG. 3A is an outer side view.
Figure 3B:
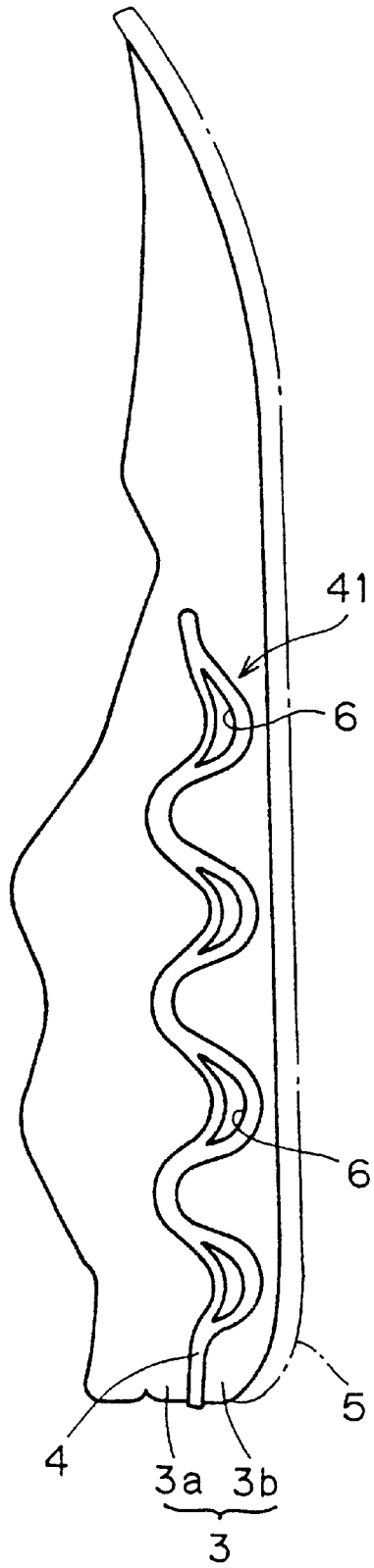
FIG. 3B is an inner side view of the midsole construction of FIG. 2.
Figure 4:
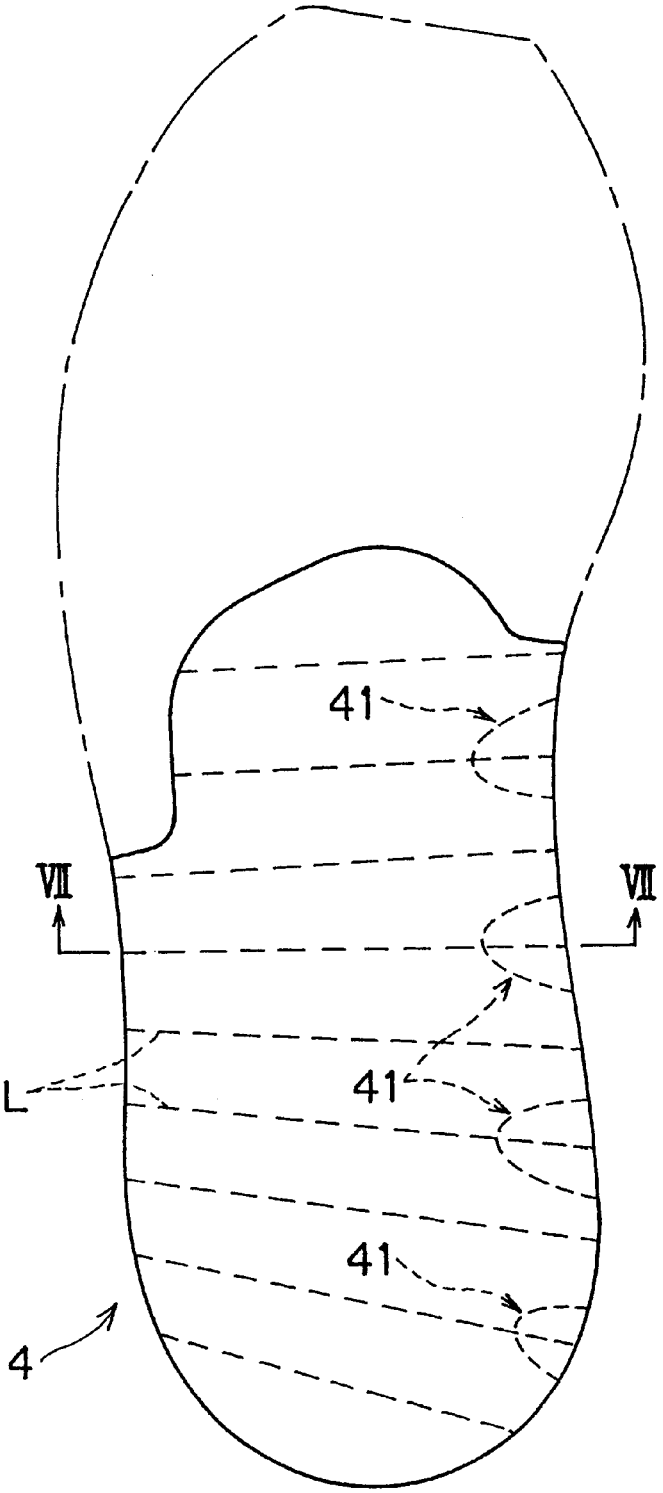
FIG. 4 is a top plan view of the corrugated sheet constituting the midsole construction of FIG. 2.
Figure 5:
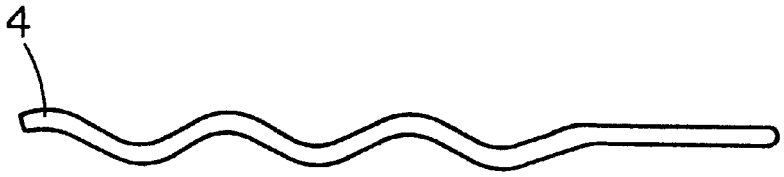
FIG. 5 is an outside end view of the corrugated sheet of FIG. 4.
Figure 6:
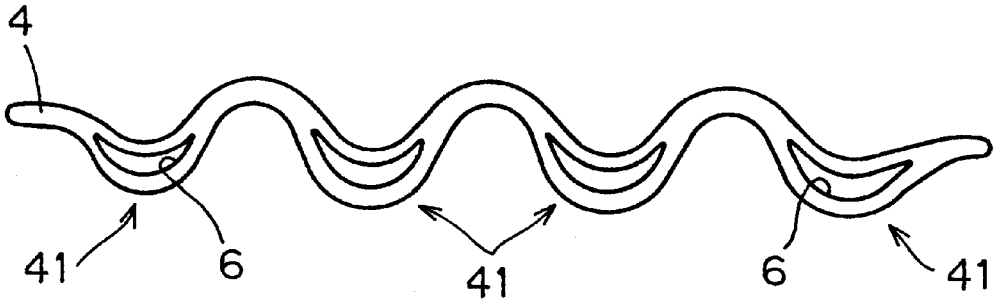
FIG. 6 is an inside end view of the corrugated sheet of FIG. 4.

A corrugated sheet 4, as shown in FIG. 2, extends from the heel portion to the plantar arch portion of a midsole 3. A broken line L in the drawing indicates the crest or trough line of the wave configuration of the corrugated sheet 4. In this case, the lines L extend radially and the radiant point is disposed apart from the outer side edge of the midsole 3.

Figure 7:
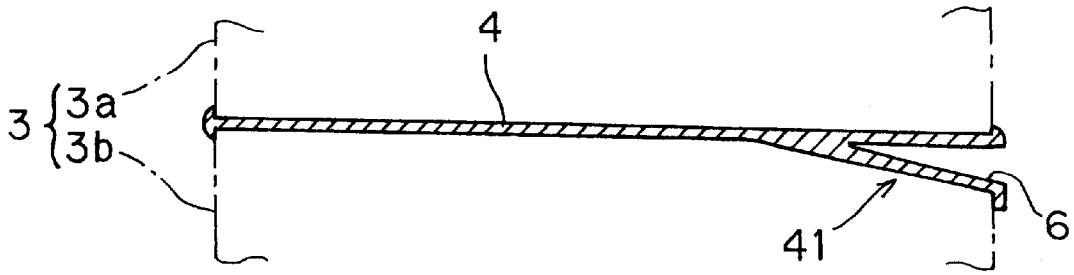
FIG. 7 is a cross sectional view taken along line VII—VII of FIG. 4.

As shown in FIGS. 3 to 7, the midsole medial side of the corrugated sheet 4 has a double structure 41 where the corrugated sheet 4 is formed doubly, i.e. with two sheet layers spaced apart from each other via a predetermined clearance or aperture or pocket 6 therebetween in the thickness direction. This double structure 41 is formed on the trough side of the wave configuration. As seen in FIG. 7, each void or pocket 6 has a tapered wedge-shaped cross-section like a segment of a cone that opens to the medial side and tapers inwardly to limit the extent or area of the double structure 41. As understood from FIGS. 4, 6 and 7, the corrugated sheet 4 has a scalloped medial edge area formed by the double structure 41, but the remaining areas of the sheet 4 have a simple single corrugation.

In this case, since the double structure 41 of the corrugated sheet 4 is formed only on the medial side of the midsole 3, the compressive hardness, or hardness to deform against the compressive force, of a midsole 3 is higher on the medial side, whereas the compressive hardness of a midsole 3 is relatively lower on the lateral side and flexibility of a midsole 3 is maintained on the lateral side. Thereby, in athletics where athletes land more frequently from the heel lateral portion, shock load on landing is effectively relieved and the cushioning properties can be ensured, and besides, transverse deformation of a heel portion after landing can be prevented.

Moreover, when the heel of a foot pronates after landing it is restrained from unnecessarily sinking toward the midsole medial side by a heel medial side portion of a larger compressive hardness. Thereby, over-pronation can be prevented and loss of athletic power can be lessened.

Figure 8:
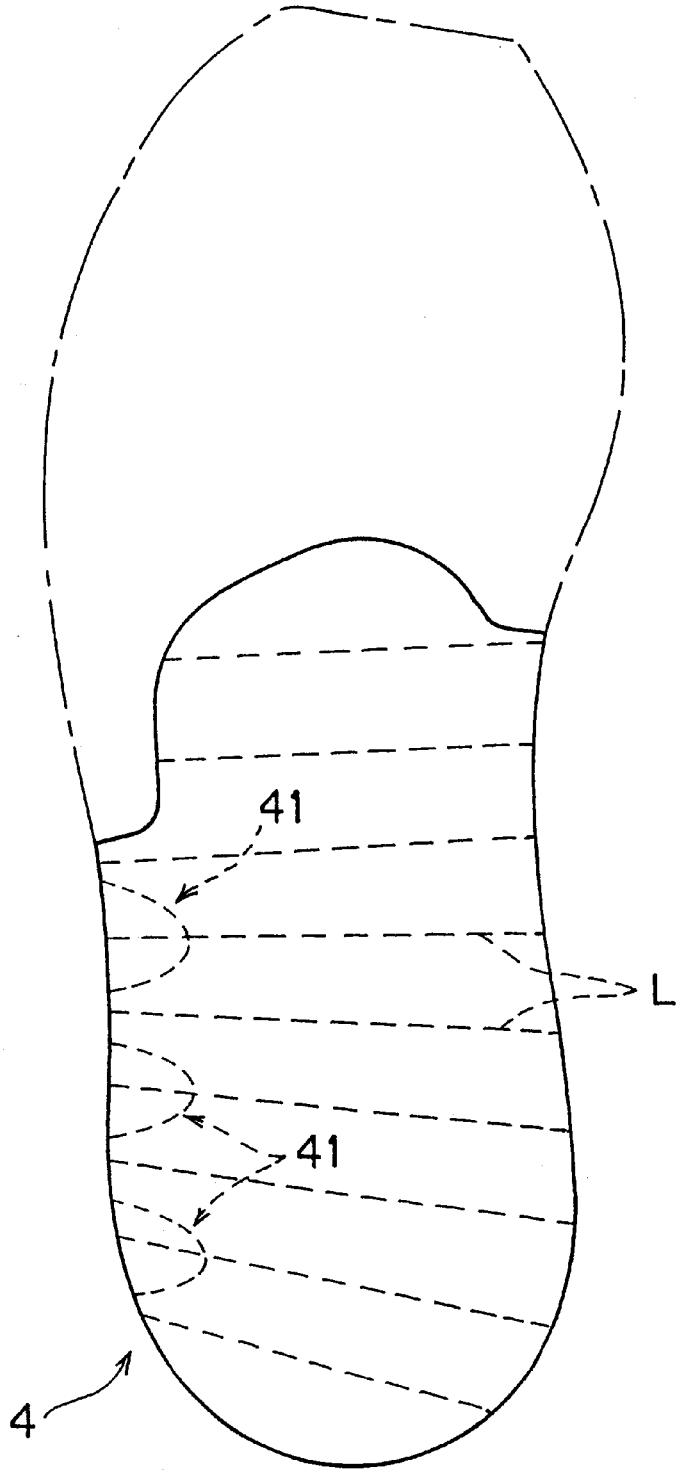
FIG. 8 is a schematic illustrating a first alternative of FIG. 4.

As shown in FIG. 8, the double structure 41 may be formed only on the lateral side of the midsole 3.

In this case, the compressive hardness of a midsole 3 is higher on the lateral side, whereas the compressive hardness of a midsole 3 is relatively lower on the medial side and flexibility of a midsole 3 is maintained on the medial side. Thereby, in athletics where athletes land more frequently from the heel medial portion, shock load on landing is effectively relieved and the cushioning properties can be ensured, and besides, transverse deformation of a heel portion after landing can be prevented.

Moreover, when the heel of a foot supinates after landing, it is restrained from unnecessarily sinking toward the lateral side of a midsole 3 by a heel lateral side portion of a larger compressive hardness. Thereby, over-supination can be prevented and loss of athletic power can be decreased.

Figure 10:
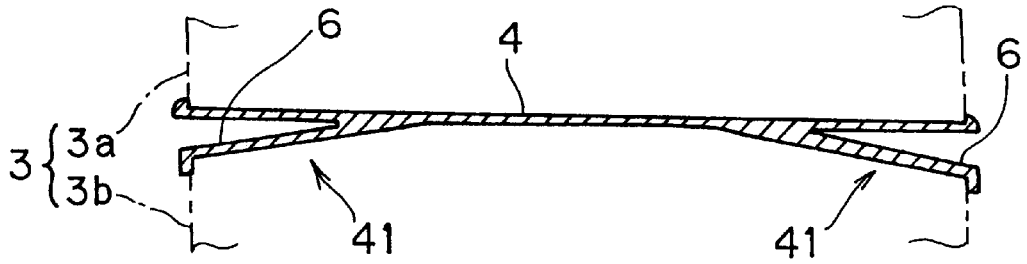
FIG. 10 is a cross sectional view taken along line X—X of FIG. 9.
Figure 9:
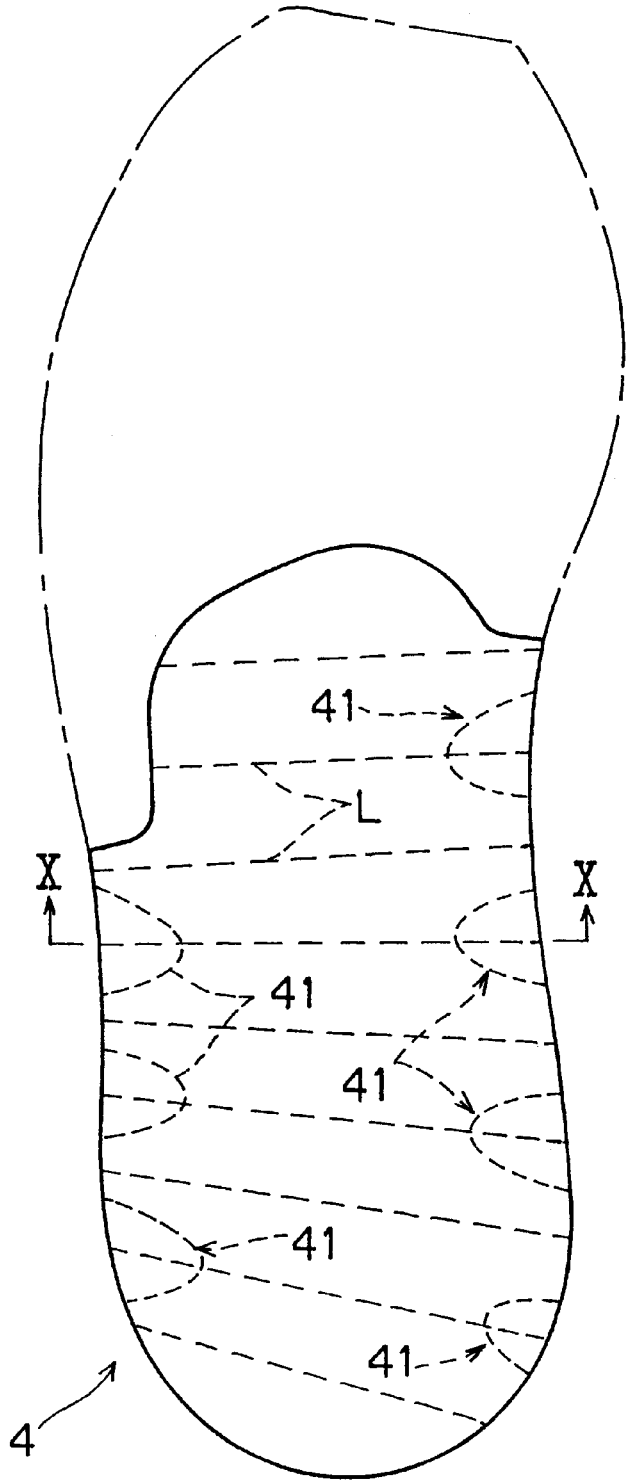
FIG. 9 is a schematic illustrating a second alternative of FIG. 4.

As shown in FIGS. 9 and 10, the double structure 41 of a corrugated sheet 4 may be formed on both the medial and lateral sides of the midsole 3.

In this case, the compressive hardness of a midsole 3 is higher on the medial and lateral sides, whereas the compressive hardness of a midsole 3 is relatively lower on the heel central portion and flexibility of a midsole 3 is maintained on this heel central portion. Thereby, the cushioning properties on landing can be ensured on the heel central portion, and besides, transverse deformation of a heel portion after landing can be prevented and the running stability can be improved. Moreover, in this case, over-supination as well as over-pronation can be effectively prevented.

In the above-mentioned embodiments, the double structure 41 is formed on the trough side of the wave configuration of the corrugated sheet 4. However the application of the present invention is not limited to these examples.

Figure 11:
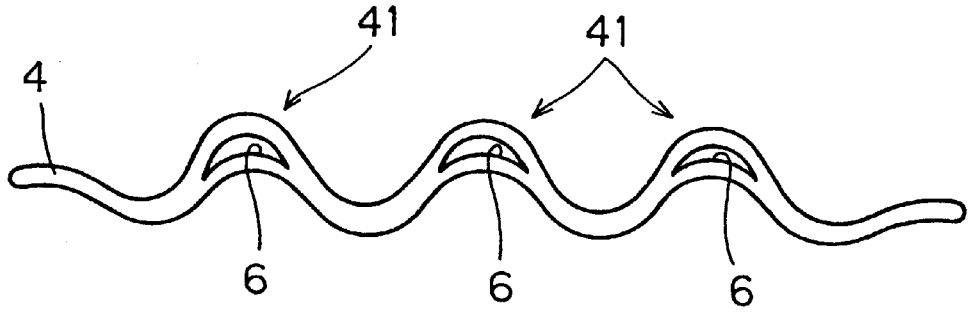
FIG. 11 is a schematic illustrating a first alternative of FIG. 6.
Figure 12:
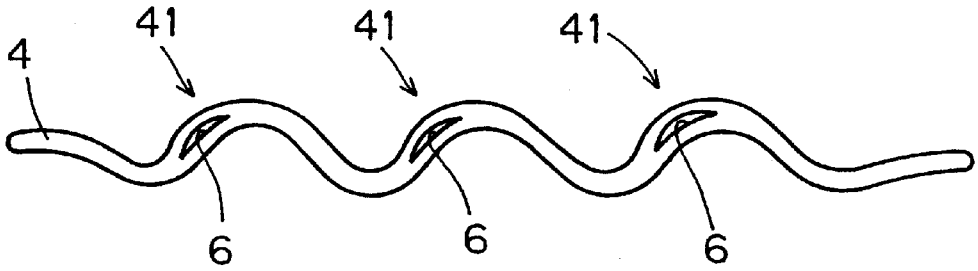
FIG. 12 is a schematic illustrating a second alternative of FIG. 6.

As shown in FIG. 11, the double structure 41 may be formed on the crest side of the wave configuration of the corrugated sheet 4, or it may be formed on the inclined surface between the adjacent crest and trough of the wave configuration of the corrugated sheet 4, as shown in FIG. 12.

In the above embodiments, the crest and trough line L of the corrugated sheet 4 extend radially and the radiant point is disposed apart from the outer circumference edge of the midsole 3, but the application of the current invention is not limited to these examples.

Figure 13:
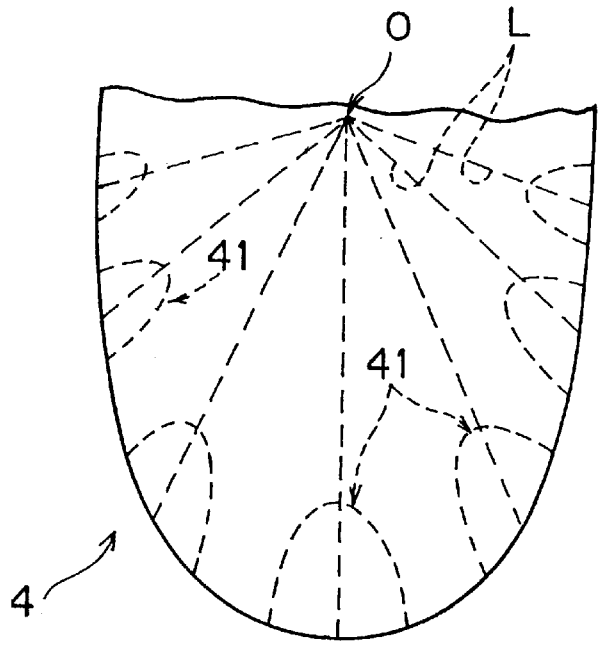
FIG. 13 is a schematic illustrating a third alternative of FIG. 4.
Figure 14:
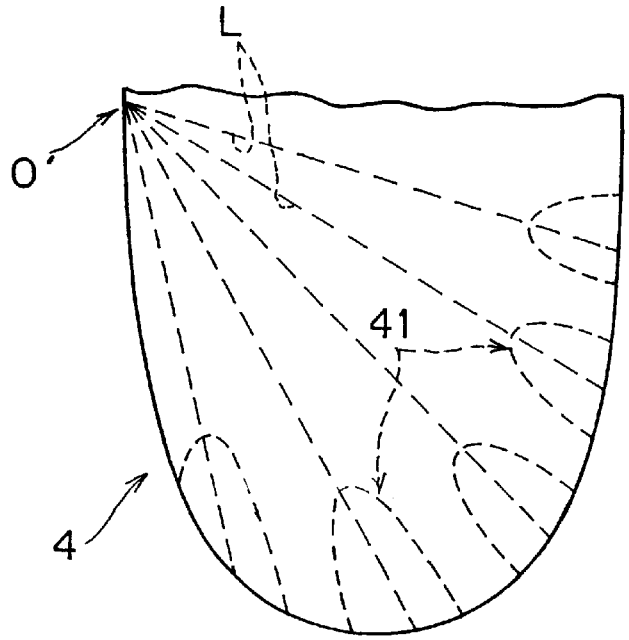
FIG. 14 is a schematic illustrating a fourth alternative of FIG. 4.

As shown in FIG. 13, the radiant point O may be placed in the heel central portion. In alternative, as shown in FIG. 14, the radiant point O' may be placed on the outer circumference edge portion of the heel portion. Furthermore, the radiant angle may be obtuse, as shown in FIG. 13, or it may be an acute angle, as shown in FIG. 14. In both cases, the double structure 41 is formed on both the crest and trough sides of the wave configuration of the corrugated sheet 4.

Figure 15:
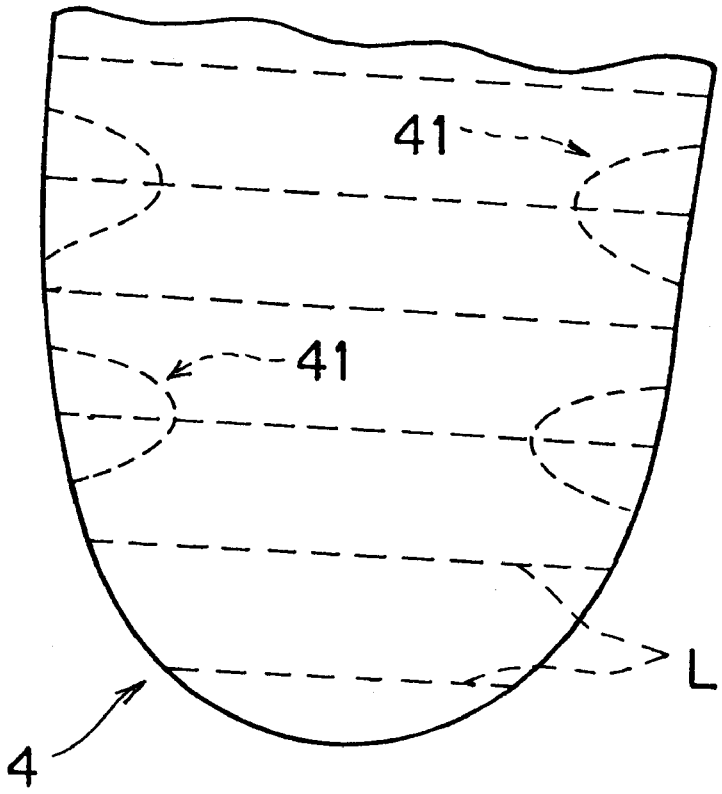
FIG. 15 is a schematic illustrating a fifth alternative of FIG. 4.

In addition, the crest and trough lines L of the wave configuration may be parallel to each other and extend in the heel width direction, as shown in FIG. 15.

Moreover, the multiple structure such as the triple structure may be substituted for the double structure 41.

Those skilled in the art to which the invention pertains may make modifications and other embodiments employing the principles of this invention without departing from its spirit or essential characteristics particularly upon considering the foregoing teachings. The described embodiments and examples are to be considered in all respects only as illustrative and not restrictive. The scope of the invention is, therefore, indicated by the appended claims rather than by the foregoing description. Consequently, while the invention has been described with reference to particular embodiments and examples, modifications of structure, sequence, materials and the like would be apparent to those skilled in the art, yet still fall within the scope of the invention.

What is claimed is:

1. A midsole assembly for an athletic shoe comprising:

a midsole including a midsole heel portion that includes an upper midsole portion and a lower midsole portion respectively formed of a soft elastic material; and a corrugated sheet that is made of a plastic resin, is disposed in said midsole at least in said midsole heel portion between said upper midsole portion and said lower midsole portion, and has an upper corrugated surface contacting and joined to said upper midsole portion and a lower corrugated surface contacting and joined to said lower midsole portion;

wherein a limited edge portion of said corrugated sheet at an outer edge of said corrugated sheet includes at least one pocket structure including plural sheet layers that are respectively spaced apart from one another in a direction perpendicular to a major extension plane along which said corrugated sheet extends, so as to form at least one void pocket respectively between neighboring spaced-apart ones of said sheet layers of said pocket structure;

wherein said void pocket is limited to said pocket structure at said limited edge portion at said outer edge of said sheet; and wherein said limited edge portion of said corrugated sheet with said at least one pocket structure provides a greater compressive hardness to said midsole assembly at said limited edge portion in comparison to another portion of said corrugated sheet without said pocket structure.

2. The midsole assembly according to claim 1, wherein said plural sheet layers of said pocket structure include exactly two of said sheet layers that are spaced apart from each other to form exactly one said void pocket therebetween, respectively in each said at least one pocket structure.

3. The midsole assembly according to claim 1, wherein said at least one pocket structure includes a plurality of said pocket structures arranged spaced apart from one another along said outer edge of said corrugated sheet.

4. The midsole assembly according to claim 3, wherein said corrugated sheet has a wave configuration including wave crests and wave troughs respectively opposite each other on said upper corrugated surface and said lower corrugated surface, with wave inclines between said wave crests and said wave troughs.

5. The midsole assembly according to claim 4, wherein said pocket structures are respectively formed on said wave crests.

6. The midsole assembly according to claim 4, wherein said pocket structures are respectively formed on said wave troughs.

7. The midsole assembly according to claim 4, wherein said pocket structures are respectively formed on both said wave crests and said wave troughs.

8. The midsole assembly according to claim 4, wherein said pocket structures are respectively formed on said wave inclines.

9. The midsole assembly according to claim 4, wherein said wave crests and said wave troughs extend along lines perpendicular to a longitudinal extension direction of said midsole assembly.

10. The midsole assembly according to claim 4, wherein said wave crests and said wave troughs extend along lines that radiate radially from a radiant center point.

11. The midsole assembly according to claim 1, wherein said outer edge is a medial edge of said corrugated sheet, and said at least one pocket structure of said limited edge portion is provided only along said medial edge.

12. The midsole assembly according to claim 1, wherein said outer edge is a lateral edge of said corrugated sheet, and said at least one pocket structure of said limited edge portion is provided only along said lateral edge.

13. The midsole assembly according to claim 1, wherein said outer edge includes a medial edge and a lateral edge of said corrugated sheet, and said at least one pocket structure of said limited edge portion is provided only along both said medial edge and said lateral edge.

14. The midsole assembly according to claim 1, wherein said void pocket is a blind pocket that is open at said outer edge of said corrugated sheet and has a closed bottom displaced inwardly from said outer edge at an inner limit of said limited edge portion.

15. The midsole assembly according to claim 1, wherein said void pocket has a tapering sectional shape like a segment of a cone that opens outwardly toward said outer edge and tapers to a point inwardly away from said outer edge.

16. The midsole assembly according to claim 1, wherein said corrugated sheet consists of a solid integral sheet of said plastic resin, including said at least one pocket structure having said void pocket therein formed at said outer edge thereof.

* * * * *

UNITED STATES PATENT AND TRADEMARK OFFICE

CERTIFICATE OF CORRECTION

PATENT NO. : 6,311,414 B1
DATED : November 6, 2001
INVENTOR(S) : Kita

It is certified that error appears in the above-identified patent and that said Letters Patent is hereby corrected as shown below:

Title page,
Item [56], References Cited U.S. PATENT DOCUMENTS, following "4,798,010…" reference, insert:

| | | |
|---|---|---|
| -- 4,815,221 | 03/1989 | Diaz |
| 5,224,280 | 07/1993 | Preman et al. |
| 5,720,118 | 02/1998 | Mayer et al. |

Signed and Sealed this

Sixth Day of August, 2002

*Attest:*

*Attesting Officer*

JAMES E. ROGAN
*Director of the United States Patent and Trademark Office*